US007058322B2

(12) United States Patent
Iwasaki et al.

(10) Patent No.: US 7,058,322 B2
(45) Date of Patent: Jun. 6, 2006

(54) TRANSFER BIAS CONTROL METHOD FOR IMAGE FORMING APPARATUS USING ELECTROPHOTOGRAPHIC PROCESS

(75) Inventors: Atsushi Iwasaki, Shizuoka (JP); Masafumi Maeda, Shizuoka (JP); Taro Ishifune, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 10/805,231

(22) Filed: Mar. 22, 2004

(65) Prior Publication Data

US 2004/0190919 A1 Sep. 30, 2004

(30) Foreign Application Priority Data

Mar. 27, 2003 (JP) ..... 2003-088730

(51) Int. Cl.
*G03G 15/00* (2006.01)

(52) U.S. Cl. ..... 399/45

(58) Field of Classification Search ..... 399/45, 399/66

See application file for complete search history.

(56) References Cited

U.S. PATENT DOCUMENTS 5,179,397 A 1/1993 Ohzeki et al. ..... 346/160
5,253,022 A 10/1993 Takeuchi et al. ..... 355/274
5,541,718 A * 7/1996 Oono ..... 399/297
5,713,063 A * 1/1998 Oono ..... 399/66
5,884,121 A * 3/1999 Kyung ..... 399/66
6,125,258 A * 9/2000 Umetani et al. ..... 399/394
6,347,200 B1 * 2/2002 Shigeta et al. ..... 399/66
6,510,296 B1 * 1/2003 Less et al. ..... 399/66
2003/0066805 A1 4/2003 Andou et al. ..... 210/754

FOREIGN PATENT DOCUMENTS

JP 8-240969 9/1996
JP 10198183 A * 7/1998
JP 2001-83812 3/2001
JP 2003-88730 3/2003

* cited by examiner

*Primary Examiner*—Quana Grainger
(74) *Attorney, Agent, or Firm*—Fitzpatrick, Cella, Harper & Scinto

(57) ABSTRACT

To prevent jamming with small-sized print materials without disturbing an image located at a trailing end of a print material, an image forming apparatus includes a photosensitive drum that carries a toner image, a transfer device which can apply a transfer bias to the transfer roller to transfer the toner image to a print material passing through the transfer nip portion, and a control device for controlling a transfer bias set value set in order to apply a predetermined transfer bias to the transfer roller. The control device switches a first transfer bias set value to a second bias set value smaller than the first transfer bias set value while the print material is passing through the transfer nip portion, in order to change the transfer bias applied to the transfer roller.

18 Claims, 10 Drawing Sheets

TRANSFER BIAS CONTROL METHOD FOR IMAGE FORMING APPARATUS USING ELECTROPHOTOGRAPHIC PROCESS

This application claims priority from Japanese Patent Application No. 2003-088730 filed Mar. 27, 2003, which is incorporated hereinto by reference.

BACKGROUND OF THE INVENTION

1. Field of the Invention

The present invention relates to an image forming apparatus and an image forming method, and more specifically, to an image forming apparatus based on an electrophotographic system or an electrostatic printing system, such as a copier or a laser beam printer.

2. Description of the Related Art

An image forming apparatus such as a copier or an LBP (Laser Beam Printer) based on an electrophotographic system has an electrophotographic photosensitive member (hereinafter referred to as a "photosensitive member") which is shaped like a rotating drum or belt and which operates as an image carrier, charging means for charging the photosensitive member to a predetermined potential, latent image forming means for forming an electrostatic latent image by exposing the photosensitive member charged by the charging means, and image forming process means for developing the electrostatic latent image.

The image forming apparatus forms a toner image on the photosensitive member which is transferable and which corresponds to image information. Then, transfer means transfers the toner image from the photosensitive member to a print material. Moreover, the print material to which the toner image has been transferred is introduced into fixing means to thermally fix the toner image to a surface of the print material as a permanently fixed image. The print material is then outputted as image formed matter (a copy or a print). After the toner image has been transferred to the print material, residual attached contaminants such as transfer residual toner or paper dusts remaining on the surface of the photosensitive member are removed (photosensitive member cleaning) so that the photosensitive member can be repeatedly used for an image forming process.

In a transfer section corresponding to a nip portion that is in pressure contact with the photosensitive member, transfer means is frequently used which uses a contact rotation type transfer member, what is called a transfer roller, which electrostatically transfers the toner image from the photosensitive member to the print material while sandwiching and conveying the print material. The transfer roller is used because it has the advantages of serving to simplify a conveying path for the print material and allowing the print material to be stably conveyed. The transfer section applies a plus bias from the transfer means which bias is the reverse of a toner charging polarity (for example, a minus charging characteristic), to the photosensitive member via the print material. Thereby, an electric field is formed to transfer the toner image from the photosensitive member to a print material.

An image forming apparatus is known which has a relatively long distance between the transfer section and the fixing section, located downstream in a conveying direction, and in which conveying auxiliary means including an elastomer roller, an elastomer belt, and the like is disposed between the transfer section and the fixing section in order to convey a print material that is shorter than the distance between the transfer section and the fixing section.

FIG. 1 shows the structure of a conveying auxiliary device in a conventional image forming apparatus. A conveying auxiliary device 16 conveys a print material P discharged from between a photosensitive drum 1 and a transfer roller 5, to the fixing device. The conveying auxiliary device 16 has an elastomer conveying belt 16*a* that is an endless belt having a width of about 5 to 100 mm. The elastomer conveying belt 16*a* has steps 16*b* of about 0.1 to 1 mm on its surface at a pitch of about 1 to 10 mm. Normally, the elastomer conveying belt 16*a* is tensioned by a plurality of shafts 23*a* and 23*b* provided on the side of a nonprinted surface of the print material. Particularly if the print material is shorter than the distance between the transfer roller and the fixing device, rotation of the driving shaft 23*a* in the conveying direction assists the conveyance of the print material already passed through a transfer nip N to the fixing device so that a trailing end of the print material in the conveying direction is pushed by the steps 16*b*.

An inlet side of the transfer nip N is defined as Na. An outlet side of the transfer nip N is defined as Nb. A central position of the transfer nip N is defined as No. If the conveying auxiliary device 16 is located too high, an unfixed image on a printed surface may be disturbed. Accordingly, considerations are given so that the conveying auxiliary device 16 is located somewhat along the conveying surface between the transfer roller and the fixing device from the transfer nip outlet Nb.

FIG. 2 shows the structure of a transfer high-voltage control circuit in a conventional image forming apparatus. Known means for varying a voltage applied to the transfer roller 5 is control that uses a pulse width modulation (PWM) system (refer to, for example, Japanese Patent No. 2951993). A PWM signal outputted by a high-voltage control section 31 passes through an LPF (Low Pass Filter) 33 provided on a primary side of a high-voltage transformer 32. The signal is thus converted into an analog signal of 0 to 5 V and has its voltage changed to become a transfer bias. Specifically, PWM control is provided to modulate the duty ratio of the pulse signal to change the voltage behind the LPF 33. The generated voltage changes in proportion to the above change. For example, if the high-voltage transformer 32 has a maximum output voltage of 5 kV, when the PWM duty ratio is 100%, 5 kV is outputted. When the PWM duty ratio has a resolution of 256 bits, a voltage per bit is about 20 V. This resolution is sufficient for the transfer high voltage. The high resolution is characteristic of the PWM system.

Another transfer voltage control system is an ATVC (Active Transfer Voltage Control) system (refer to, for example, Japanese Patent No. 2614309). The ATVC system carries out constant voltage control during a non-paper-passing period when no print materials are present in the transfer section. The ATVC system then determines a constant voltage control value for a paper passing period on the basis of a currently retained voltage. A transfer application bias is determined on the basis of 1) a multiple of the retained voltage, 2) a multiplication of the retained voltage by a coefficient, 3) a constant voltage, or 4) a combination of 1) to 3), using appropriate timings in a particular sequence. With the PWM method, a PWM value occurring during constant voltage control is retained. Then, on the basis of this PWM value, a PWM value is determined which is used for constant voltage control while paper is being passed through the apparatus.

A description will be given of an example of a transfer control sequence for the conventional image forming apparatus. Constant current control is started at a predetermined time during forward rotation after a print signal has been received. A PWM value that corresponds to a desired current value is stored, and a PWM average value for one rotation of the transfer roller is defined as PWMo (a high-voltage output value corresponding to PWMo is defined as Vo). After the constant current control has been finished and before a leading end of the print material reaches the transfer nip inlet Na, the transfer bias control value remains at PWMo (constant voltage Vo control). Subsequently, while a toner image is being transferred, PWM based on the PWMo, that is, a print bias: PWMt=a*PWMo+b (a and b are constants; PWMt>PWMo) is outputted (the high voltage output value corresponding to PWMt is defined as Vt). Then, before a trailing end of the print material reaches the transfer nip inlet Na, the PWMt output is switched to the PWMo output. Subsequently, the application of the transfer high voltage is turned off at a predetermined time to complete transfer control.

Control is conventionally used in which the transfer bias is switched from Vt to Vo when the trailing end of the print material passes through the transfer section and is reduced when there are no print materials in the transfer section N (this control will hereinafter be referred to as non-paper-passing bias control). This control prevents the surface of the photosensitive member from being disadvantageously charged with a positive bias voltage received from the transfer roller while no paper is being passed (hereinafter referred to as photosensitive member plus memory). For example, as disclosed in Japanese Patent Application Laid-open No. 2001-083812, a switch timing is ordinarily set at a time when a bottom margin of an image is transferred, that is, a time after a toner image has been completely transferred and before the trailing end of the print material reaches the transfer nip N. Furthermore, while the trailing end of the print material is passing through the transfer nip N, the photosensitive member plus memory produces notably significant effects. Accordingly, while the trailing end of the print material is passing through the transfer nip N, weak bias application control (hereinafter referred to as trailing end bias control) having a transfer bias control value of Vo/2 or less may be provided.

However, in the conventional image forming apparatus, inappropriate conveyance or jamming may be caused by the following factors in connection with the passage of print materials such as index cards used in a low humidity environment which materials have a certain level of rigidity and which is light and small.

A dry high-resistance print material is likely to retain charges on its nonprinted surface (the charges are unlikely to be attenuated). Accordingly, when the trailing end of the print material passes through the transfer nip outlet Nb, the plus charges retained on the nonprinted surface are likely to be attracted to the negatively charged surface of the photosensitive member via the trailing end of the print material. Consequently, the state shown in FIG. 1 is likely to result.

For example, a small-sized sheet of a high resistance which has been left and dried in a low humidity environment, for example, an index card P of 3×5 inch size (76.2 mm×127 mm) and 0.3 mm thickness, is passed through an image forming apparatus having a distance of 200 mm between the transfer roller and the fixing device. After the trailing end of the index card P in the conveying direction has come out of the transfer section and before its leading end reaches the fixing section, the index card P floats owing to its is rigidity and light weight so that its trailing end extends along a rotating direction a of the photosensitive drum 1. The index card P cannot contact with the conveying belt 16*a* and remains between the transfer roller and the fixing device. As a result, jamming may result.

In particular, in an image forming apparatus which has a print speed of more than 100 mm/sec and in which the high voltage transformer has a fall time (in this case, the time from the switching from the transfer bias Vt to trailing end bias control until a drop to half of Vt or less) of 0.05 sec or more, the trailing end of the print material passes through the transfer nip N early during a fall time. Consequently, the bias drop cannot appropriately follow the passage and an excessive amount of charges are likely to be retained at the trailing end. Therefore, the above-described jamming may result.

The transfer bias control in the conventional image forming apparatus will be described with reference to FIGS. 3A and 3B. FIG. 3A shows a transfer bias control value for the vicinity of the trailing end of the print material in an image forming apparatus having a print speed of 150 mm/sec, a transfer high-voltage transformer fall time of 0.05 sec, and a transfer nip width of 4 mm. FIG. 3B shows the effective value of the transfer bias. The time at which the trailing end of the print material P passes through the central position No of the transfer nip is defined as a time reference zero. The switching timing for the trailing end bias control is −17 msec, when a position of the print material P located 2.5 mm away from its trailing end passes through the nip center No. The trailing end bias control has a bias value of Vo/2. The switching timing for the non-paper-passing bias control is +17 msec. The non-paper-passing bias value is Vo.

FIG. 3B indicates that while the trailing end of the print material is passing through the transfer nip N, the trailing end bias control applies Vo/2. However, a high voltage of Vo or more is actually applied under the effects of the print speed and fall time. If the bias switching timing corresponds to the time immediately before the trailing end of the print material passes through the transfer section, substantially no trailing end bias acts on the trailing end of the print material owing to the tradeoff between the print speed and high-voltage fall time. As a result, the apparatus may be jammed with the above described small-sized paper.

SUMMARY OF THE INVENTION

It is an object of the present invention to provide an image forming apparatus and method which can prevent jamming with small-sized print materials without disturbing an image formed at the trailing end of a print material.

To accomplish this object, the present invention provides an image forming apparatus having an image carrier that carries a toner image, transfer means which includes a transfer member forming a transfer nip portion together with the image carrier and which can apply a transfer bias to the transfer member to transfer the toner image carried on the image carrier to a toner image transfer area of a print material passing through the transfer nip portion, and control means for controlling a transfer bias set value set in order to apply a predetermined transfer bias to the transfer member. In this case, the control means switches a first transfer bias set value to a second bias set value smaller than the first transfer bias set value while the toner image transfer area of the print material is passing through the transfer nip portion in order to change the transfer bias applied to the transfer member.

With this configuration, the transfer bias applied when the trailing end of the print material passes through the transfer nip portion can be reduced to the degree that the trailing end can be easily separated from a photosensitive body. Specifically, for high-resistance, light, and small-sized print materials such as index cards left in a low-humidity environment which materials have a conveying length shorter than the distance between a transfer roller and a fixing device, it is possible to convey such a print material to the fixing section after its trailing end comes out of the transfer section and without causing the trailing end to float along the rotating direction of the photosensitive member. This serves to prevent inappropriate conveyance and jamming resulting from the inappropriate separation between the trailing end of the print material and the photosensitive drum.

With this configuration, a switching timing for the bias value is determined on the basis of the tradeoff between a conveying speed and the fall time of the transfer bias. Therefore, a favorable image can be obtained even at the trailing end of the print material.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below in detail with reference to the drawings.

First Embodiment

Figure 4:
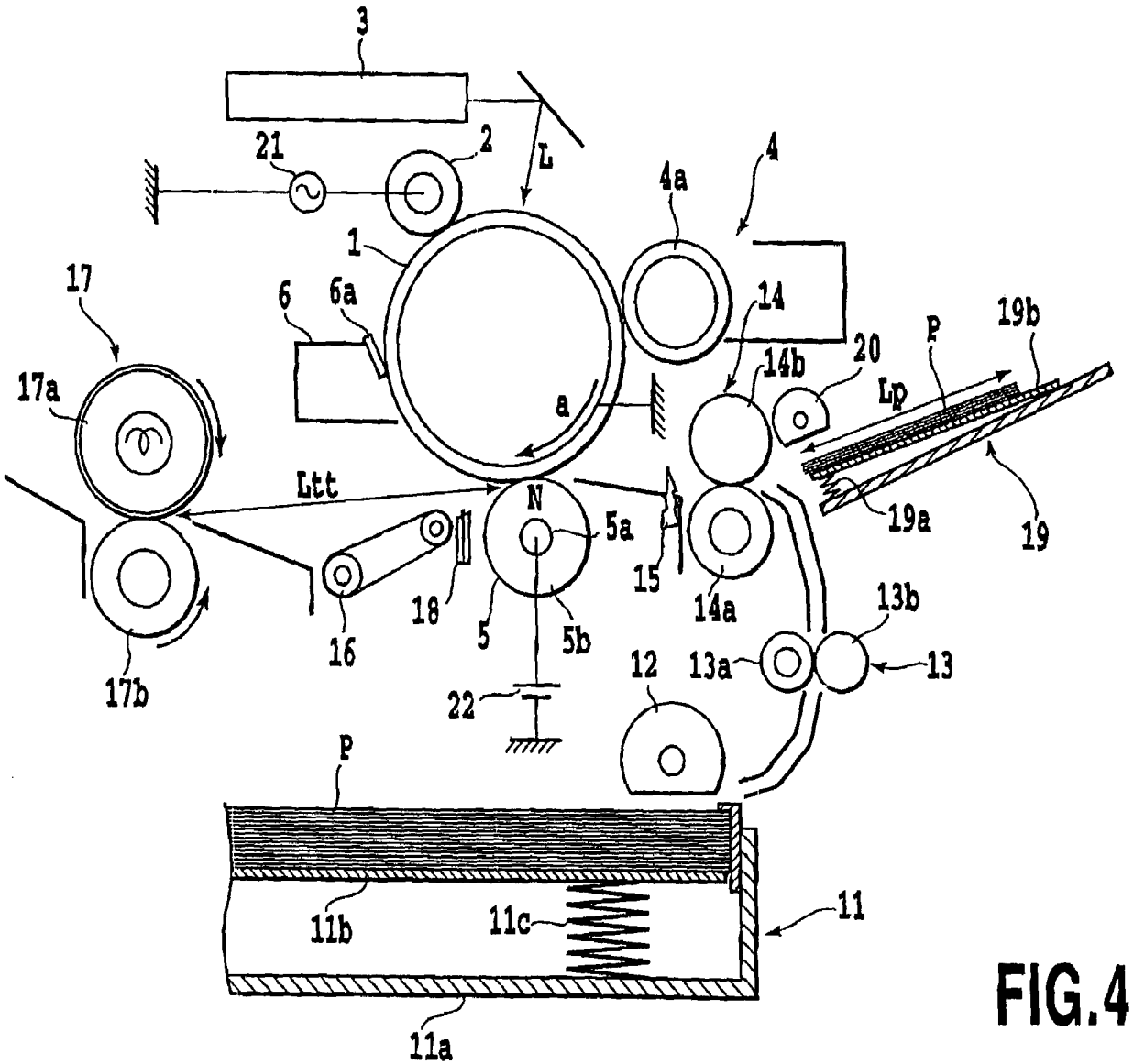
FIG. 4 is a diagram showing the structure of an image forming apparatus according to a first embodiment of the present invention.

FIG. 4 is a diagram showing the configuration of an image forming apparatus according to a first embodiment of the present invention. The image forming apparatus comprises a photosensitive drum 1 that rotates in the direction of an arrow a. A charging roller 2, an exposure device 3, a developing device 4, a transfer roller 5, and a cleaning device 6 are disposed around the photosensitive drum 1. A first paper feeding cassette 11, a first paper feeding roller 12, an intermediate conveying roller pair 13, a registration roller pair 14, a print material sensor 15, a conveying auxiliary device 16, and a fixing device 17 are disposed in this order from an upstream side in a conveying direction of a print material P on which an image is formed. The print material P is conveyed by the second paper feeding roller 20 from the second paper feeding cassette 19 to the registration roller pair 14.

The photosensitive drum 1 comprises a photosensitive material such as OPC or amorphous Si formed on a cylindrical substrate such as aluminum or nickel. The photosensitive drum 1 is rotatively driven by driving means (not shown) in the direction of the arrow a, that is, clockwise at a predetermined peripheral speed. In the present embodiment, the photosensitive drum 1 is a cylindrical rotating member of outer diameter 30 mm comprising an OPC layer formed on a cylinder composed of aluminum.

The charging roller 2, which is a contact charging device, contacts with a surface of the photosensitive drum 1 at a predetermined pressure. The charging roller 2 thus charges the photosensitive drum 1 to a predetermined polarity and a predetermined potential using a charging bias applied by a charging bias power source 21.

In the present embodiment, the exposure device 3 as latent image forming means is a laser beam scanner. The exposure device 3 has a semiconductor laser, a polygon mirror, an fθ lens, and other components (none of these components are shown in the drawings). The exposure device 3 emits laser light L controlled to be turned on and off in accordance with image information transmitted by a host apparatus (not shown). The exposure device 3 scans and exposes the uniformly charged surface of the photosensitive drum 1 to form an electrostatic latent image on the photosensitive drum 1.

The developing device 4 comprises a rotatable developing sleeve 4*a* containing a fixed magnet roller (not shown). Toner is coated on the developing sleeve 4*a* so as to form a thin layer. Thus, at a developing position, the toner is attached to the electrostatic latent image formed on the photosensitive drum 1, to make a toner image visible.

During a transfer operation, the transfer roller 5, which is a transfer member, contacts with the surface of the photosensitive drum 1 at a predetermined pressure. Then, at a transfer nip N between the photosensitive drum 1 and the transfer roller 5, the toner image on the surface of the photosensitive drum 1 is transferred to the print material P using a transfer bias applied by a transfer high-voltage control circuit 22. In the present embodiment, the transfer roller 5 is an elastomer roller having a resistance value of $3\times10^{8}$ Ω (measured when 2 kV is applied) and an outer diameter of 15 mm and obtained by curing and molding an elastic layer 5*b* on an iron core of outer diameter 6 mm, the elastic layer 5*b* being composed of EPDM in which a conductive filler such as carbons or a metal oxide is distributed. The transfer roller 5 is pressurized by a spring (not shown) against the photosensitive drum 1 at a total pressure of 1 kgf. The transfer nip N is 4 mm.

The fixing device 17 has a heating roller 17*a* and a pressurizing roller 17*b*. The print material P to which the toner image has been transferred is conveyed to between the heating roller 17*a* and the pressurizing roller 17*b*. Then, the print material P is heated and pressurized to fix the toner image to its surface.

Now, a description will be given of an image forming operation performed by the image forming apparatus. The photosensitive drum 1 is rotatively driven by the driving means (not shown) in the direction of the arrow a. The photosensitive drum 1 is charged by the charging roller 2 to a first predetermined potential of −600 V. Then, the exposure device 3 irradiates the photosensitive drum 1 with laser light L corresponding to an image signal. The potential on the photosensitive drum 1 is attenuated to a second predetermined value of −150 V in a part of the drum 1 which is irradiated with the laser light L. Thus, an electrostatic latent image is formed. The developing device 4 develops toner of a minus charging polarity on the electrostatic latent image formed by the irradiation with the laser light L. Thus, a toner image is formed.

The print materials P are fed by the first paper feeding roller 12 one by one from the first paper feeding cassette 11. The print material P is then conveyed by the relay transfer roller pair 13 to the registration roller air 14. Alternatively, the print material P is conveyed by the second paper feeding roller 20 from the second paper feeding cassette 19 to the registration roller pair 14. The print material P then passes through the print material sensor 15, which operates as print material sensing means, and is then conveyed to the transfer nip N between the photosensitive drum 1 and the transfer roller 5. In this case, the print material sensor 15 detects the passage of the leading and trailing ends of the print material P in the conveying direction, to provide each control timing.

Figure 1:
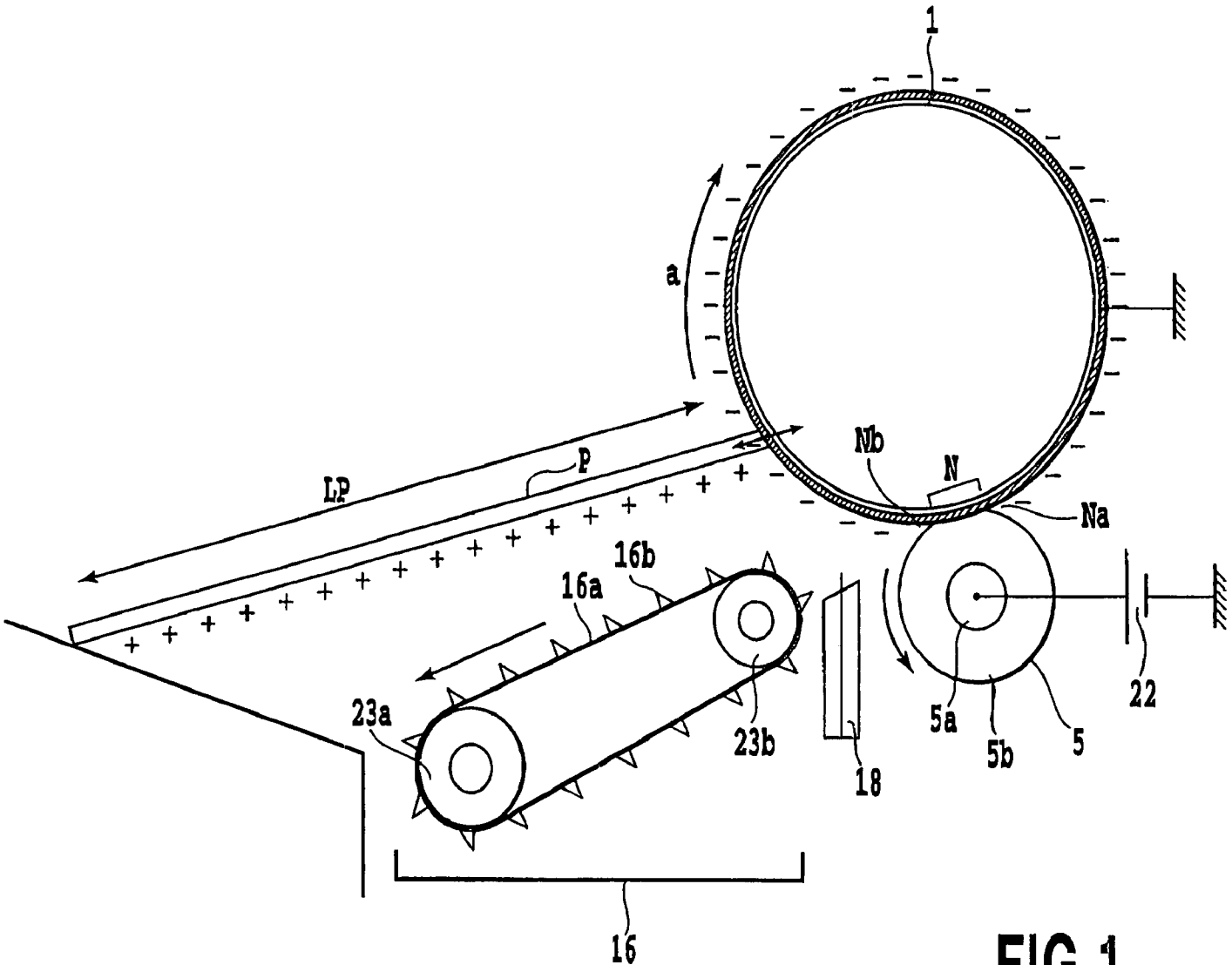
FIG. 1 is a diagram showing the structure of a conveying auxiliary device in a conventional image forming apparatus.
Figure 2:
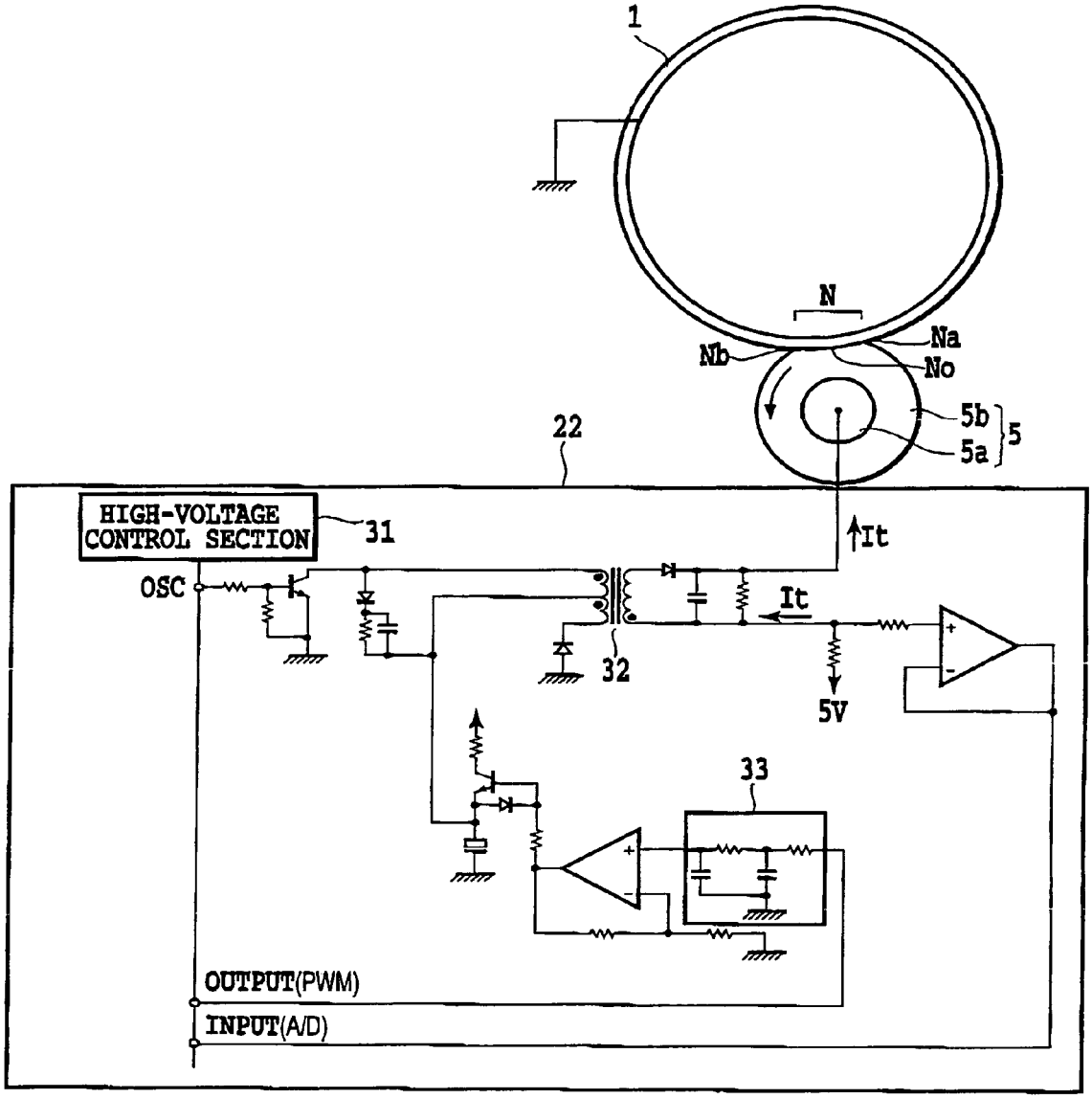
FIG. 2 is a diagram showing the structure of a transfer high-voltage control circuit in the conventional image forming apparatus.
Figure 3A:
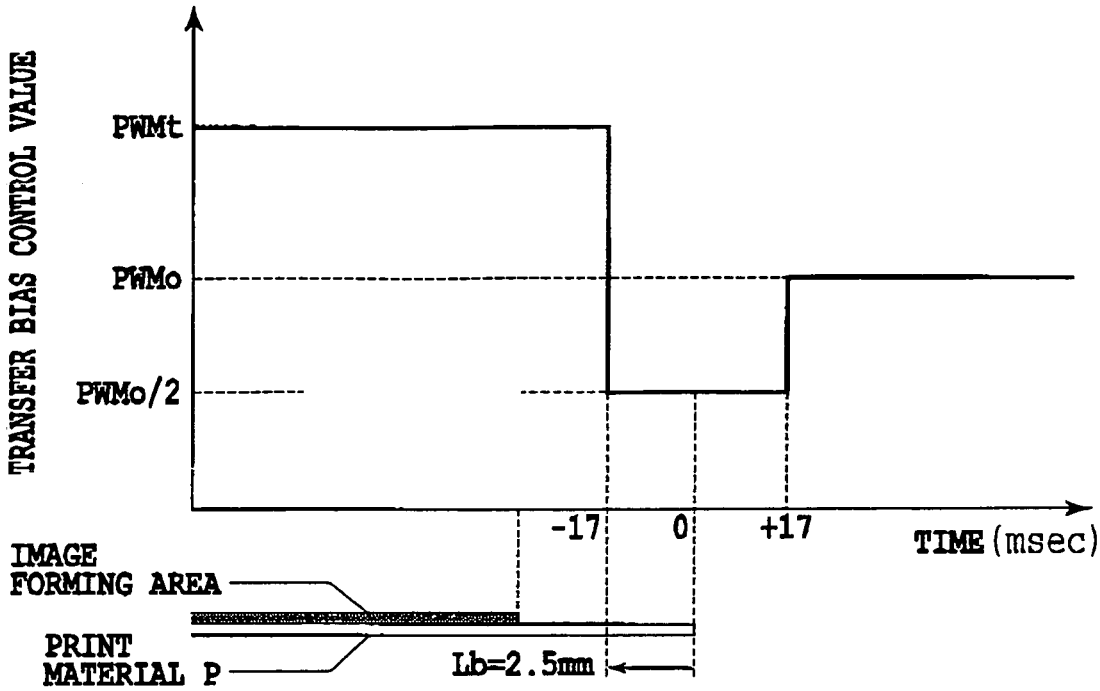
FIGS. 3A and 3B are charts showing transfer bias control in the conventional image forming apparatus.
Figure 3B:
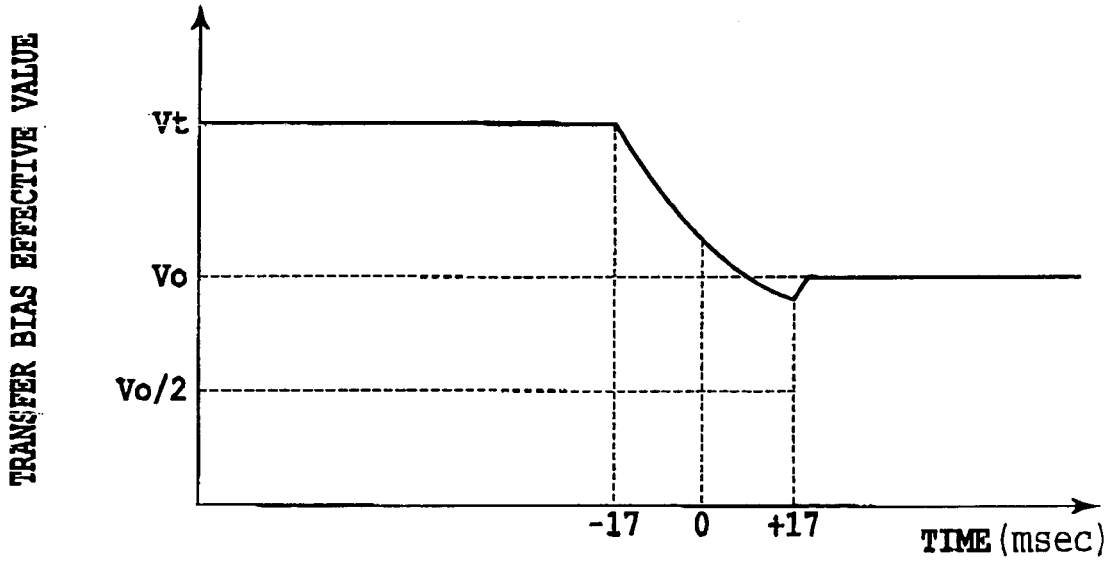

The transfer high-voltage control circuit 22 as control means for controlling the transfer bias set value applies a predetermined transfer plus bias to the transfer roller 5. The toner image is thus transferred from the photosensitive drum 1 to the print material P. In this case, the transfer high-voltage control circuit 22 is composed of the circuit shown in FIG. 2 to control transfer on the basis of the above-described PWM. The above-described ATVC control system is used as a transfer voltage control system.

With the PWM control, constant current control for one rotation of the transfer roller is provided for the transfer roller 5 during rotation before printing. Then, a PWM average value (PWMo) is retained an on the basis of this value, a PWM value for constant voltage control for paper passing is determined. The transfer bias during paper passing is composed of a print bias PWMt (voltage Vt) that is a first transfer bias, a second transfer bias applied to the trailing end of the print material P, that is, a bias value PWMe (Ve) for trailing end bias control, and a bias value PWMk (Vk) for non-paper-passing bias control provided during a non-paper-passing period including an inter-paper period after the print material P has passed through the transfer nip N.

The print material P to which the toner image has been transferred is separated from of the photosensitive drum 1 owing to curvature separation. A static eliminating needle 18 located immediately behind the transfer section removes excess charges from the print material P. The print material P separated from the photosensitive drum 1 is conveyed to the fixing device 17. Then, the heating roller 17*a* and pressurizing roller 17*b* of the fixing device 17 heat and pressurize the print material P to fix the transfer toner image to the print material P as a permanently fixed image.

On the other hand, a cleaning blade 6*a* of a cleaning device removes residual toner and other attachments from the surface of the photosensitive drum 1 from which the toner image has been transferred. After the cleaning, the next image forming process is started.

Figure 5A:
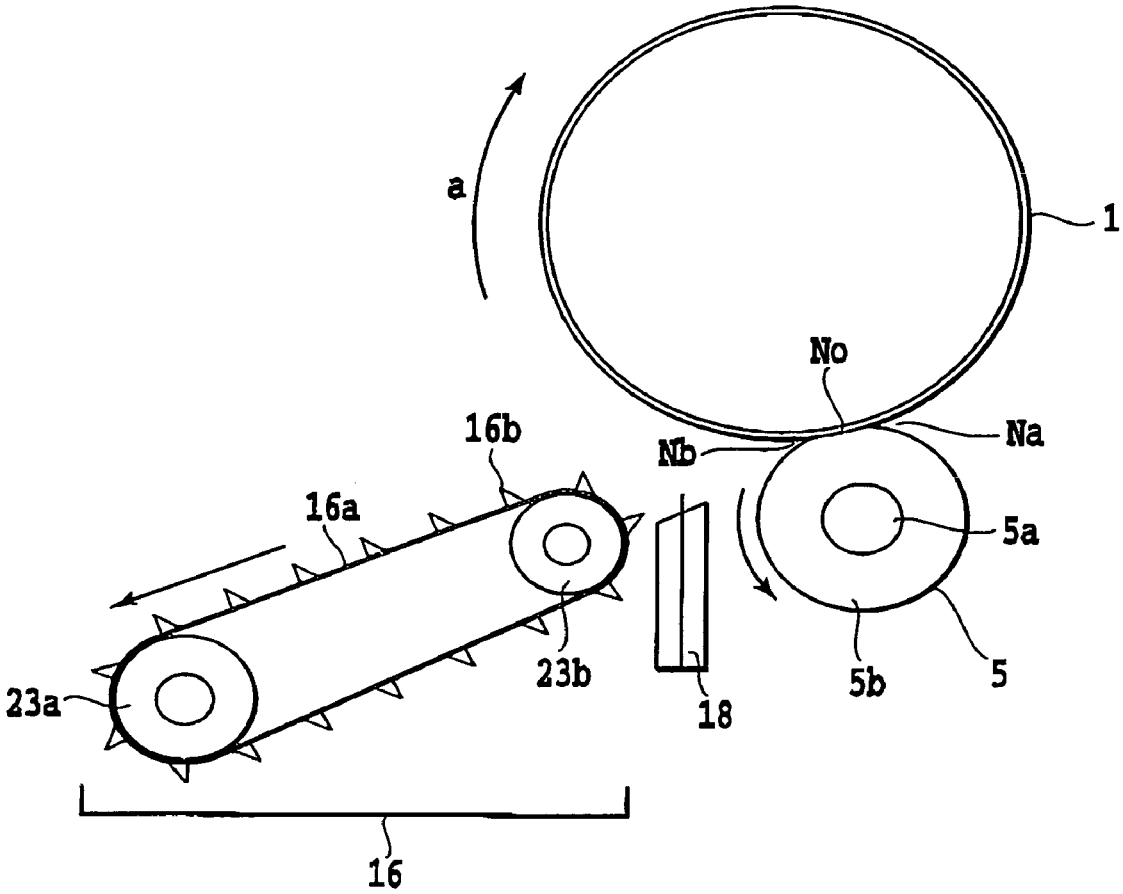
FIGS. 5A and 5B are diagrams showing the structure of a conveying auxiliary device according to a first embodiment of the present invention.
Figure 5B:
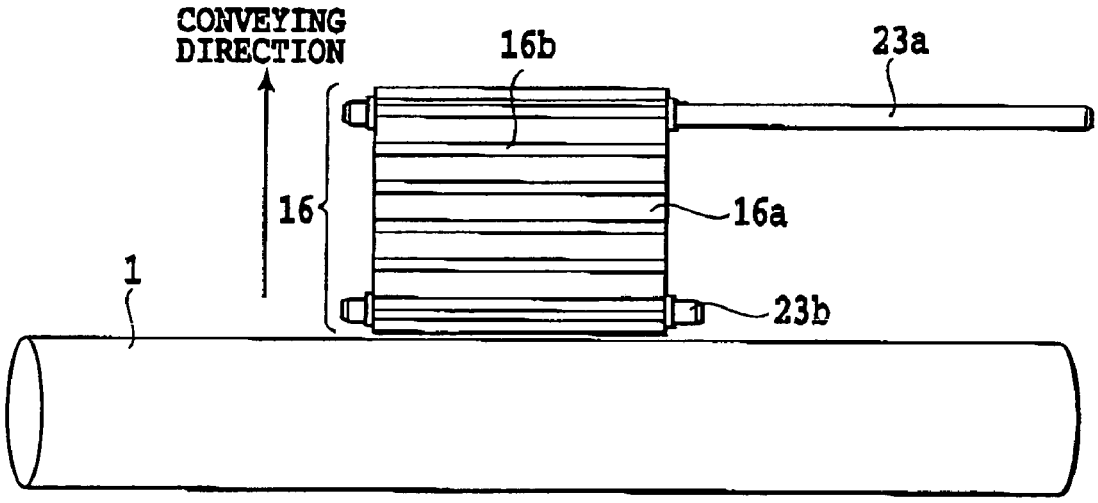

FIGS. 5A and 5B show the structure of the conveying auxiliary device according to the first embodiment of the present embodiment. FIG. 5A is a sectional view of the conveying auxiliary device 16, and FIG. 5B is a plan view. The conveying auxiliary device 16 is a conveying member that guides, to the fixing device 17, a print material that is shorter than the distance between the transfer roller and the fixing device. For example, the elastomer conveying belt 16*a* is an endless belt formed of a rubber material such as EPDM and having a width of about 5 to 100 mm. The elastomer conveying belt 16*a* has steps 16*b* of about 0.1 to 1 mm on its surface at a pitch of about 1 to 10 mm. Normally, the elastomer conveying belt 16*a* is tensioned by a plurality of shafts 23*a* and 23*b* provided on the side of a nonprinted surface of the print material. Particularly if the print material is shorter than the distance between the transfer roller and the fixing device, rotation of the driving shaft 23*a* in the conveying direction assists the conveyance of the print material already passed through the transfer nip N to the fixing device 17 so that the trailing end of the print material in the conveying direction is pushed by the steps 16*b*.

It is known that small-sized print materials can be more stably conveyed by setting the driving speed of the conveying 16*a* to be higher than the conveying speed of the print material P. Thus, in the present embodiment, the outer peripheral speed of the conveying belt 16*a* is set at 105% of the conveying speed of the print material P at the transfer nip N.

Here, it is assumed that the distance Ltt from a transfer nip outlet Nb to the fixing device 17 is 200 mm and that the conveying speed Vp of the print material P is 150 mm/sec. A print bias is:

$$PWMt=a*PWMo+b \text{ (}a\text{ and }b\text{ are constants).}$$

A high-voltage output value corresponding to PWMt is defined as Vt. A trailing end bias is defined as PWMc, and a non-paper-passing bias is defined as PWMk=PWMo(Vo). The fall time t from the start of switching to the trailing end bias PWMe till a drop to the half of Vt is 0.05 sec. The distance from a transfer position set at the start of the trailing end switching to the trailing end of the print material P is defined as Lb. An image forming area of the print material P in its conveying direction is an area extending from a position 5 mm away from the leading end to a position 5 mm away from the trailing end.

Figure 6A:
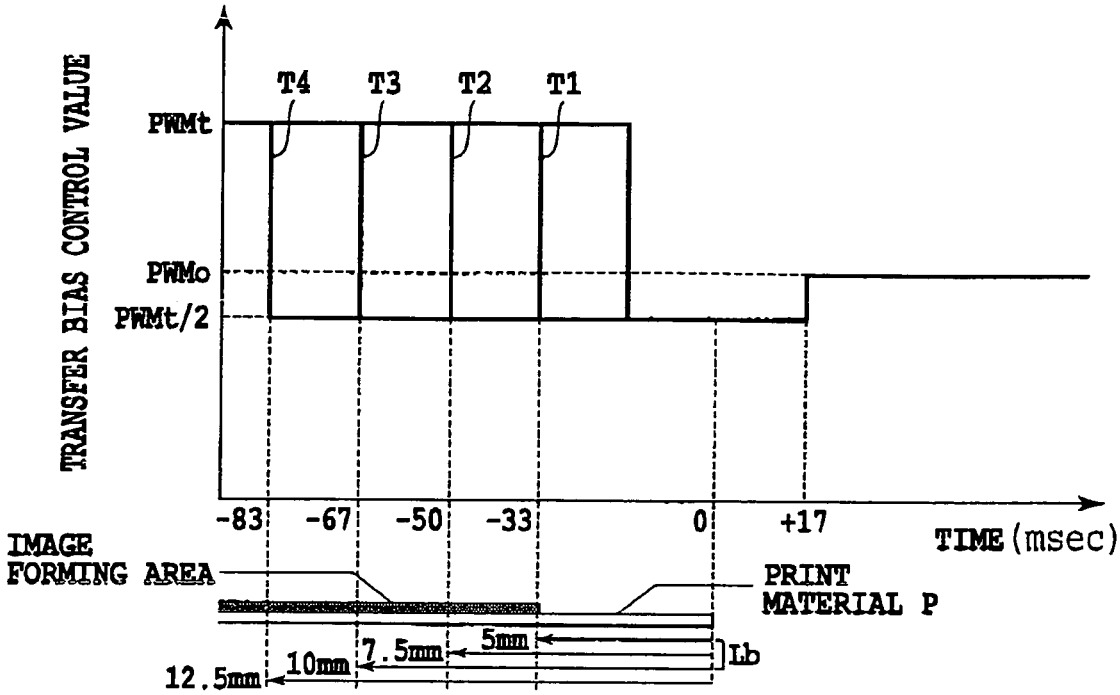
FIGS. 6A and 6B are charts showing a first example of results of evaluations of transfer bias control according to the first embodiment of the present invention.
Figure 6B:
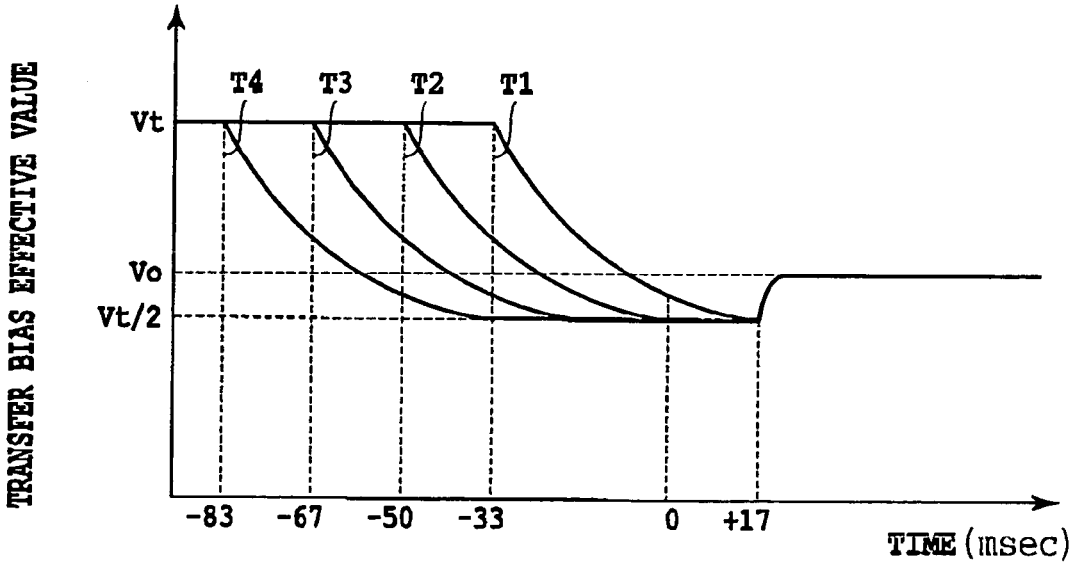

FIGS. 6A and 6B show a first example of results of evaluations of the transfer bias control according to the first embodiment of the present invention. FIG. 6A shows transfer bias control timings for the vicinity of the trailing end of the print material P. The time when the trailing end of the print material P passes through a central position No of the transfer nip was defined as time reference zero. Timings for switching to the trailing end bias control were T1=−33 msec, T2=−50 msec, T3=−67 msec, and T4=−83 msec, when positions located 5 mm, 7.5 mm, 10 mm, and 12.5 mm, respectively, away from the trailing end of the print material P passed through the transfer nip center No.

A timing for the non-paper-passing is +17 msec. The trailing end bias PWMe is the half of the print bias PWMt and is set equal to PWMt/2. Here, Lb=5 mm, 7.5 mm, 10 mm, or 12.5 mm.

FIG. 6B shows the transition of the effective value of the transfer bias based on the transfer bias control. If the timings for switching to the trailing end bias control is set as described above, then except for the switching timing at T1, the trailing end bias Vt/2 can be reliably applied to the print material P while its trailing end is passing through the transfer nip center No. The timing for switching to the trailing end bias control occurs during the transfer to the image forming area of the print material P. However, after the switching, within the image forming area, the high voltage keeps dropping and thus a relatively high voltage is applied.

Table 1 shows the results of image evaluations executed using the image forming apparatus according to the first embodiment.

TABLE 1

| | Comparative example | T1 | T2 | T3 | T4 |
|---|---|---|---|---|---|
| Trailing end bias control value | PWMt/2 | PWMt/2 | PWMt/2 | PWMt/2 | PWMt/2 |
| Trailing end bias switching timing (msec) | −17 | −33 | −50 | −67 | −83 |
| Number of sheets remaining owing to jamming | 25 | 10 | 1 | 1 | 0 |
| Trailing end image evaluation | good | good | good | medium | bad |

This table shows the number of sheets remaining between the transfer roller and the fixing device because of jamming when 100 index cards of 3×5 inch size (76.2 mm×127 mm) and 0.3 mm thickness which had been left and dried in a low humidity environment were passed through the apparatus, as well as the results of evaluations of images of the image forming area obtained after the trailing end bias switching. As a comparative example, an image forming apparatus was used in which the timing for switching to the trailing end bias control, conventional transfer control, was −17 msec, when a position of the print material P located 2.5 mm away from the trailing end of the print material P passed through the nip center No.

Table 1 indicates that in connection with the number of sheets remaining owing to jamming, the likelihood of jamming is high for the comparative example and the timing T1, whereas the likelihood is very low for the timings T2, T3, and T4. When the transfer bias control according to the present embodiment was used to evaluate images of the trailing end of the image forming area, a slightly inappropriate transfer was observed in images of the image forming area corresponding to the switching timings T3 and T4. The other transferred images were favorable. This is simply because a substantially high transfer bias is applied to the image forming area within the transfer nip N after switching to the trailing end bias and before the image forming area comes out of the transfer nip outlet Nb.

Figure 7A:
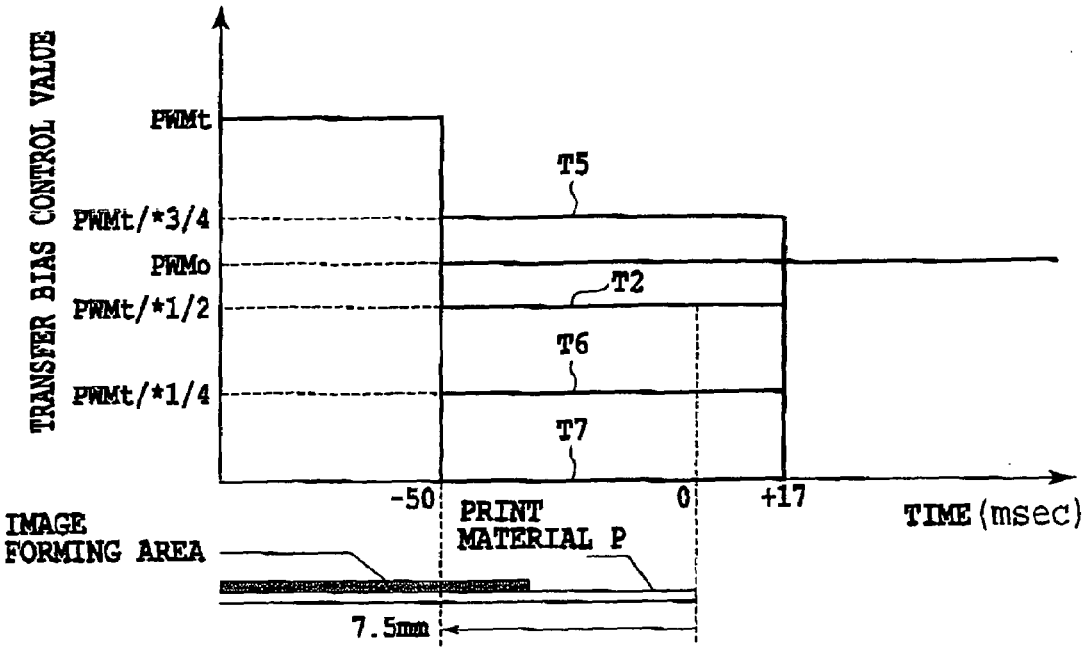
FIGS. 7A and 7B are charts showing a second example of results of evaluations of the transfer bias control according to the first embodiment of the present invention.
Figure 7B:
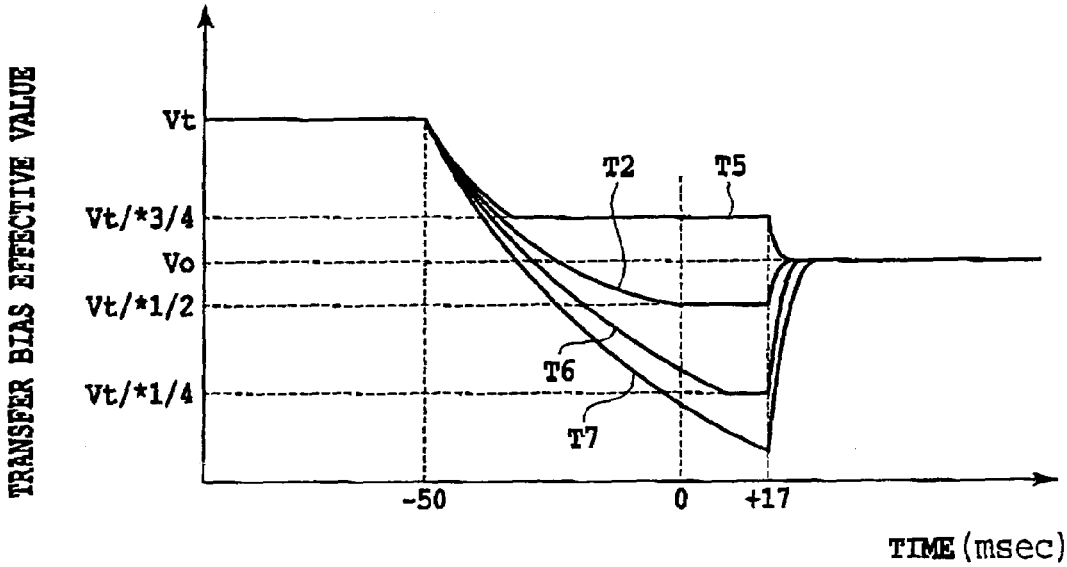

FIGS. 7A and 7B show a second example of results of evaluations of the transfer bias control according to the first embodiment of the present invention. The timing for the switching to the trailing end bias control is fixed at −50 msec, when a position of the print material P located 7.5 mm away from its trailing end passes through the nip center No. The bias values of the trailing end bias control were 0.75 times (T5), 0.5 times (T2), 0.25 times (T6), and 0 times (T7), respectively, as large as the print bias PWMt. FIG. 7A shows transfer bias control timings for the vicinity of the trailing end of the print material P. FIG. 7B shows the transition of the effective value of the transfer bias based on the transfer bias control. As in the case of the first example of evaluation results, Table 2 shows the number of sheets remaining owing to jamming and the results of image evaluations obtained by passing 100 index cards through the apparatus.

TABLE 2

| | Comparative example | T5 | T2 | T6 | T7 |
|---|---|---|---|---|---|
| Trailing end bias control value | PWMt/2 | PWMt*3/4 | PWMt/2 | PWMt/4 | 0 |
| Trailing end bias switching timing (msec) | −17 | −50 | −50 | −50 | −50 |
| Number of sheets remaining owing to jamming | 25 | 19 | 1 | 0 | 0 |
| Trailing end image evaluation | good | good | good | good | good |

FIG. 7B indicates that depending on the bias value of the trailing end bias control, the curve of the drop in high voltage does not vary markedly but the time required to reach the control bias varies. Table 2 indicates that if the bias value of the trailing end bias control is equal to or smaller than half of the print bias Vt, it is possible to reduce the effective value of the bias applied while the trailing end of the print material P is passing through the transfer nip N. This makes it possible to inhibit the index cards from remaining owing to jamming and to provide favorable images of the image forming area.

According to the first embodiment, by optimizing the switching timing and bias control value for the transfer bias control in accordance with the conveying speed and the high-voltage drop time, it is possible to inhibit paper from remaining owing to jamming and to provide favorable images even of the image forming area located at the trailing end of the print material.

In the above description, the first embodiment is based on the constant voltage transfer control using the ATVC control system as a transfer bias control system. However, the present invention is not limited to this aspect. Even with constant current transfer control, similar effects car be produced by optimizing trailing end bias switching timings and a constant current control value.

Second Embodiment

In the first embodiment, the transfer bias control is provided for print materials P of all sizes suitable for passing through the apparatus. In connection with the possible jamming between the transfer roller and the fixing device, if the print material P is longer than the distance between the transfer roller and the fixing device, the transfer bias control according to the present invention need not be provided. There are various types of print materials of such a large size and they have a variety of transfer characteristics. Among others, for print materials having a small margin for the transfer bias because of their high surface resistance or for other reasons, a slight drop in transfer bias in the image forming area may cause a transferred image, notably a halftone image to be inappropriately transferred.

In the second embodiment, the times when the leading and trailing ends of the print material P pass by the print material sensor 15 are stored to calculate the length Lp of the print material P in the conveying direction. The calculated length is compared with the distance Ltt (in the present embodiment, this distance is set at 200 mm) from the transfer nip outlet Nb to the fixing device 17. Then, on the basis of the result of the comparison, it is determined whether or not to provide the transfer bias control according to the present invention. The configuration of the image forming apparatus, the configuration of the conveying auxiliary device, and the method of transfer bias control are the same as those in the first embodiment.

The print material sensor 15 is disposed upstream of the transfer nip N as shown in FIG. 4. The times when the leading and trailing ends of the print material P pass by the print material sensor 15 are stored in a CPU (not shown) to calculate the length of the print material P in the conveying direction. Thus, control is determined in accordance with the passage timings.

Figure 8:
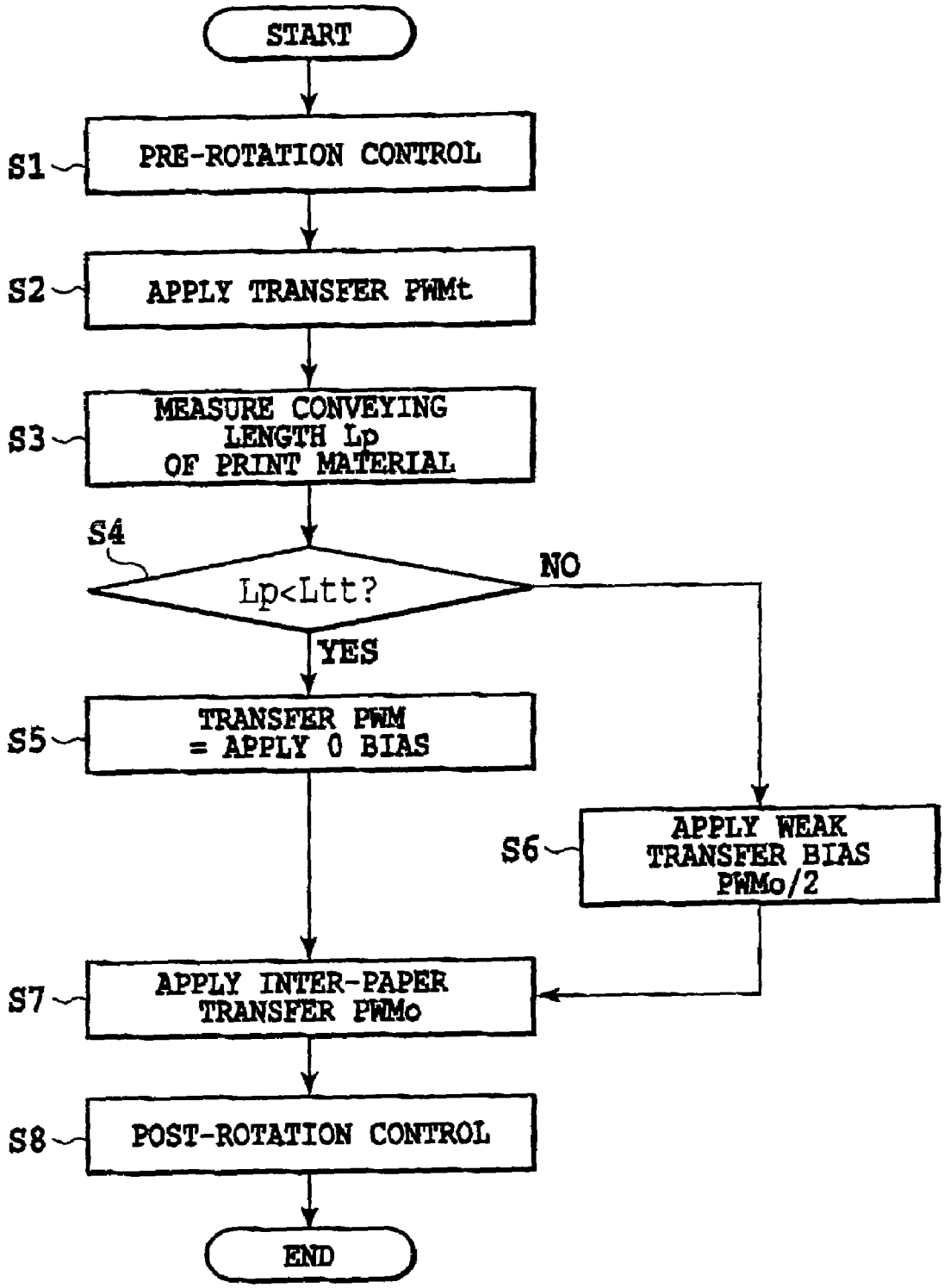
FIG. 8 is a flowchart showing transfer bias control according to a second embodiment of the present invention.

FIG. 8 is a flowchart showing the transfer bias control according to the second embodiment. The image forming apparatus receives a print signal. Then, pre-rotation control including the ATVC control is started. The print material P is fed from the first paper feeding cassette 11 or the second paper feeding cassette 19 at a predetermined time. Then, the leading end of the print material P passes by the print material sensor 15 (S1). In accordance with this passage timing, when the leading end of the print material P reaches the transfer nip inlet Na, the transfer print bias Vt starts to be applied (S2).

The print material P is conveyed and its trailing end passes by the print material sensor 15. Then, this timing is stored in the CPU to calculate the length Lp of the print material P in the conveying direction relative to the leading end reach timing (S3). Then, the CPU compares the distance Ltt=200 mm with the length Lp of the print material P in the conveying direction (S4). If Lp<Ltt, the process switches to the transfer bias control. In the second embodiment, when the position of the print material P located 7.5 mm away from its trailing end passes through the transfer nip center No, the transfer trailing end bias PWMe=0 is applied (S5).

At step S4, if Lp≧Ltt, the switching timing of the conventional bias control is used, that is, when the position of the print material P located 2.5 mm away from its trailing end passes through the transfer nip center No, the transfer trailing end bias PWMe=PWMo/2 is applied (S6). At either step S5 or step S6, after the trailing end of the print material P has passed through the transfer nip outlet Nb, that is, when the trailing end of the print material P has been conveyed by 2.5 mm after passing through the transfer nip center No, the bias of the non-paper-passing bias control PWMk=PWMo is controllably applied (S7). Finally, the process shifts to post-rotation control (S8) and ends.

According to the present embodiment, the transfer bias control according to the second embodiment is provided only for small-sized print materials such as index cards which may cause jamming. Consequently, a large margin is obtained for possible jamming. Furthermore, large-sized print materials are provided with the conventional transfer bias control. This serves to prevent the inappropriate transfer of an image located at the trailing end of a print material having a small margin for the transfer bias.

In the second embodiment, the print material sensor 15 is used to calculate the length of the print material P in the conveying direction to determine the transfer control method. However, the present invention is not limited to this aspect. It should be appreciated that similar effects can be produced by using, as print material sensing means, information on the paper size and the image forming area obtained upon the reception of a print signal, to determine the transfer control method.

Third Embodiment

Jamming occurs with dry, (high-resistance) small-sized print materials. Accordingly, the other print materials need not be subjected to the transfer bias control according to the present invention. In an image forming apparatus used in the present embodiment, loads between the transfer roller 5 and the print material P and the photosensitive drum 1 vary depending on the environment used. Consequently, the transfer bias may have a small margin. A slight drop in transfer bias in the image forming area may cause a transferred image, notably a halftone image to be inappropriately transferred.

The image forming apparatus according to the third embodiment has a print material resistance sensing device 24 that can sense the value of resistance in a thickness direction of the print material P. The sensed resistance value Rp is compared with a predetermined threshold R1 to determine whether or not to provide the transfer bias control according to the present invention. The configuration of the image forming apparatus, the configuration of the conveying auxiliary device, and the method of transfer bias control are the same as those in the first embodiment.

Figure 9:
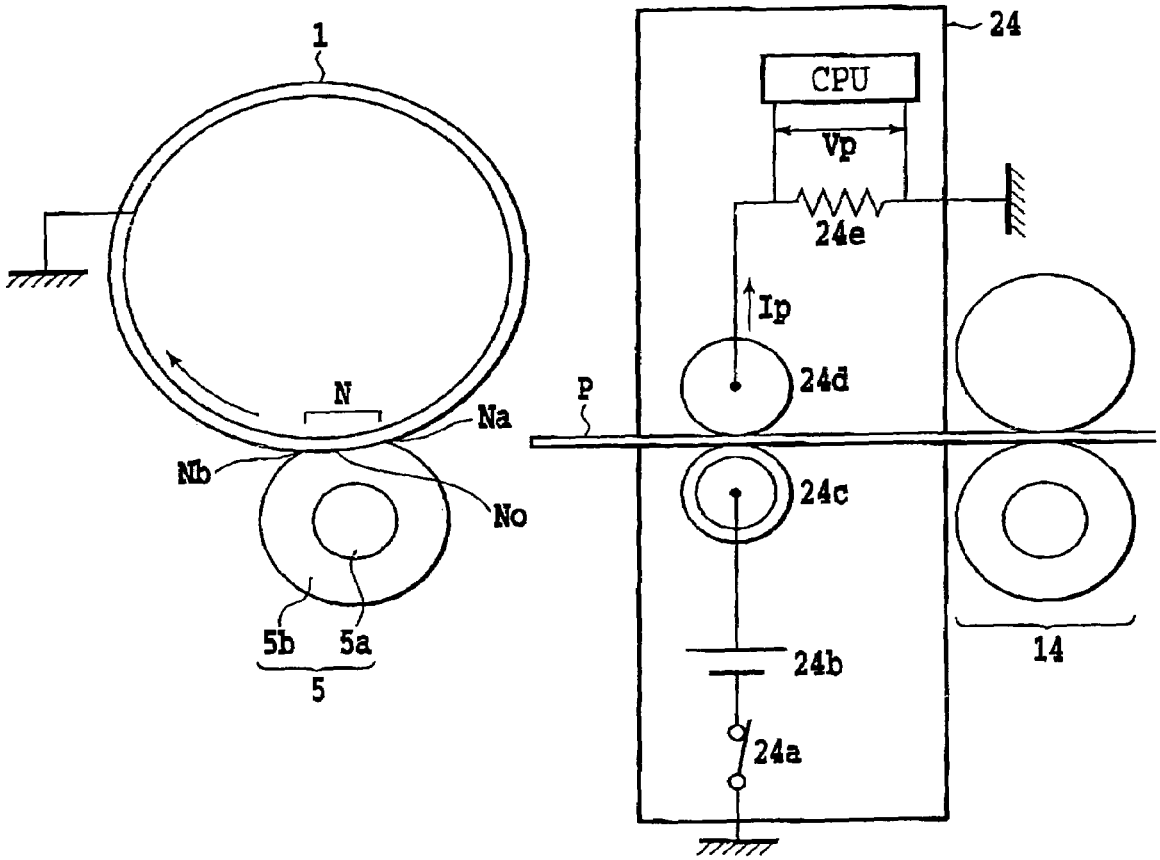
FIG. 9 is a diagram showing the structure of a print material resistance sensing device according to a third embodiment of the present invention.

FIG. 9 shows the structure of the print material resistance sensing device according to the third embodiment of the present invention. The print material resistance sensing device 24 is disposed upstream of the transfer nip N to sense the value of the resistance of the print material P while it is passing through the device 24. Specifically, to detect the resistance, it is possible to apply a bias to the print material P to monitor a current value or form an electric field on the print material P to monitor its attenuation. However, once the leading end of the print material P reaches the transfer nip N, the operation of the resistance sensing device 24 is turned off or attenuated in order to prevent the leakage of a transfer current. The detected resistance value Rp of the print material P is stored in the CPU.

Figure 10:
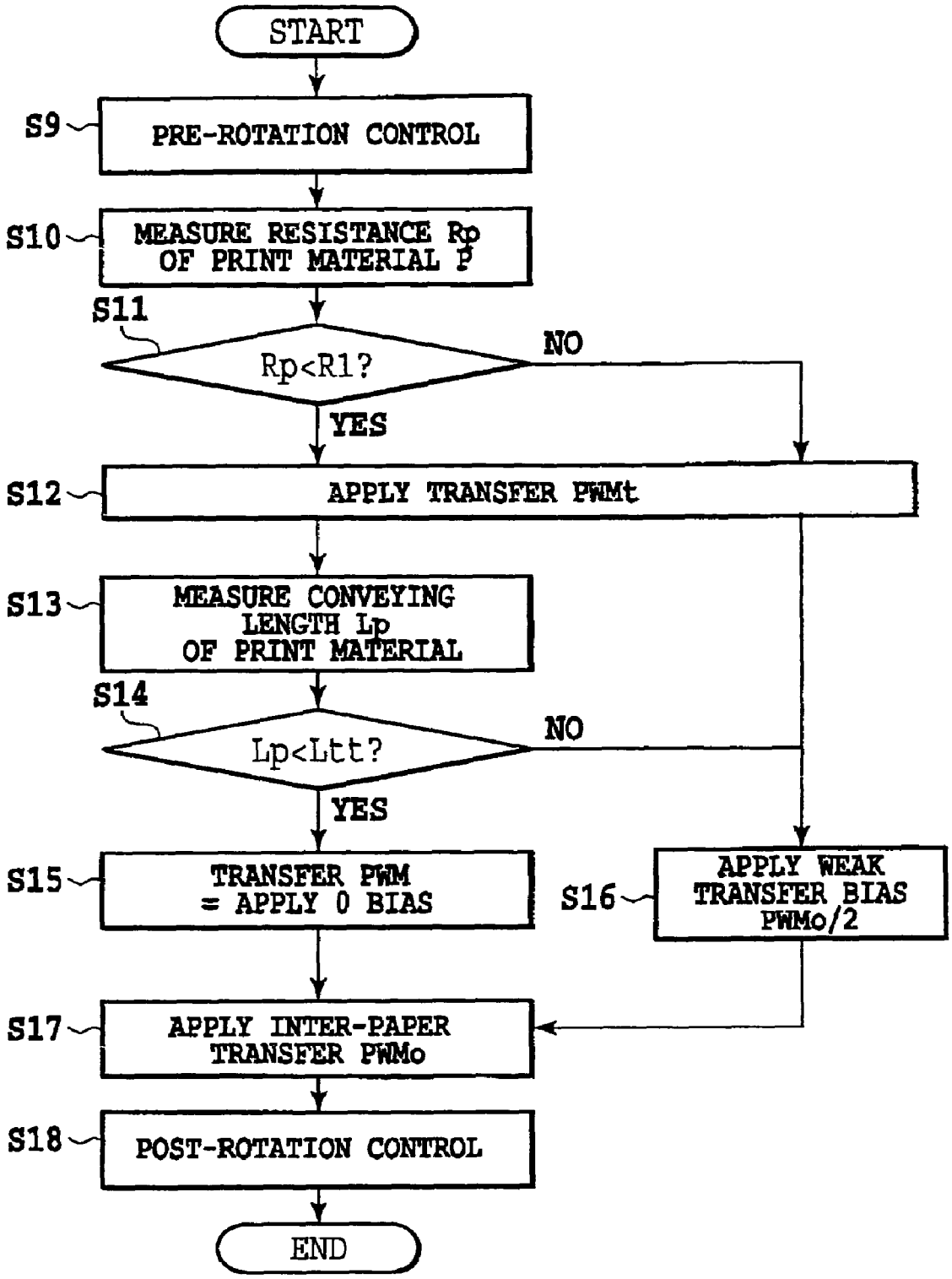
FIG. 10 is a flowchart showing transfer bias control according to a third embodiment of the present invention.

FIG. 10 is a flowchart showing the transfer bias control according to the third embodiment of the present invention. The image forming apparatus receives a print signal. Then, pre-rotation control including the ATVC control is started. The print material P is fed from the first paper feeding cassette 11 or the second paper feeding cassette 19 at a predetermined time (S9). While the print material P is passing through the print material sensing device 24, the resistance value Rp of the print material P is detected (S10). The detected resistance value Rp is stored in the CPU.

Then, the CPU compares the resistance threshold R1 of the print material P with the resistance value Rp of the print material P (S11). If Rp>R1, the process shifts to step S13 via step S12. If Rp≦R1, the process shifts to the normal transfer bias control in step S16 via step S12.

In the third embodiment, R1=$10^{13}$ Ωcm is set. If the process shifts to step S13, when the trailing end of the print material P passes by the print material sensor 15, the CPU calculates the length Lp of the print material P in the conveying direction from this passage timing (S13). The CPU compares the distance Ltt=200 mm with the length Lp of the print material P in the conveying direction (S14). If Lp<L5, the CPU switches to the transfer bias control according to the present invention. At step S15, when the position of the print material P located 7.5 mm away from its trailing end passes through the transfer nip center No, the bias of the trailing end bias control PWMe=0 is applied.

At step S14, if Lp≧Ltt, the process shifts to the normal transfer bias control. At step S16, when the position of the print material P located 2.5 mm away from its trailing end passes through the transfer nip center No, the transfer trailing end bias PWMe=PWMo/2 is applied (S6). At either step S5 or step S6, after the trailing end of the print material P has passed through the transfer nip outlet Nb, that is, when the trailing end of the print material P has been conveyed by 2.5 mm after passing through the transfer nip center No, the bias of the non-paper-passing bias control PWMk=PWMo is controllably applied (S17). Finally, the process shifts to post-rotation control (S18) and ends.

According to the present embodiment, the transfer bias control according to the third embodiment is provided only for high-resistance print materials the trailing end of which may be inappropriately separated as well as small-sized print materials such as index cards which may cause jamming. Consequently, a large margin is obtained for possible jamming.

In the third embodiment, the print material resistance sensing device 24 is separately disposed. However, the present invention is not limited to this aspect. A mechanism similar to the print material resistance sensing device 24 may be provided in the first paper feeding roller 12 and second paper feeding roller 20 provided with a conductive material or the registration roller pair 14 also provided with a conductive material.

Alternatively, the resistance value of the print material may be estimated on the basis of the values of a voltage and a current applied to the transfer roller 5. For example, the resistance value of the print material can be estimated on the basis of a current differential or the like obtained upon the application of a constant voltage before and after the print material P enters the transfer nip N.

Moreover, the print material resistance sensing device 24 is desirably shorter than the width of the print material P in a longitudinal direction (which is orthogonal to the conveying direction). The resistance of the print material can be more accurately sensed by also using information on the width of the print material P based on the image information obtained upon the reception of a print signal, or print material width sensing means (not shown).

Fourth Embodiment

In the first to third embodiments, the transfer roller is obtained by curing and molding the elastic layer 5*b* on the iron core of outer diameter 6 mm, the elastic layer 5*b* being composed of EPDM in which a conductive filler such as carbons or a metal oxide is distributed. In the fourth embodiment, the elastic layer 5*b* is composed of a polymer conductive material consisting of NBR (nitrite-butadiene rubber), ECO (epichlorohydrin rubber), urethane rubber, or the like which is provided with a conductive material (for example, this is disclosed in Japanese Patent Application Laid-open No. 8-240969 (1996)). The transfer roller 5 has a resistance value of $3\times10^8$ Ω (the resistance value obtained at 23° C./60% RH and 2 kV) and an outer diameter of 15 mm. The configuration of the image forming apparatus, the configuration of the conveying auxiliary device, and the method of transfer bias control are the same as those in the first embodiment.

A polymer conductive transfer roller constitutes a more uniform conductor because the polymer itself, which constitutes the material, has conductive ions. Compared to conventional electron conductive (for example, carbon conductive) transfer rollers, the polymer conductive transfer roller offers a stable resistance to an applied voltage or external pressure. Furthermore, the polymer conductive transfer roller is known to undergo only a small difference in resistance between the rotating direction and the longitudinal direction and in resistance among fine surface areas as well as few secular changes. Consequently, the polymer conductive transfer roller can output stable transferred images and has thus been gathering much attention in the recent years.

The advantages described below are obtained by using the polymer conductive material as the elastomer layer 5*b* of the transfer roller 5 according to the fourth embodiment. With an electron conductive transfer roller, it is difficult to uniformly disperse an electron conductive material (carbons or the like). Consequently, the differences in resistance among the fine areas of the roller surface tend to result in a mixture of areas in which the transfer bias is discharged to create a concentrated flow of the transfer current and areas in which in contrast no transfer current flows. A mixture of inappropriate phenomena (a black spot phenomenon and a toner splashing phenomenon) caused by such excess and shortage of the transfer current are present in the same print material.

On the other hand, the polymer conductive transfer roller has a much more uniform electric conductive characteristic than the electron conductive transfer roller. Consequently, there are few differences in resistance among the fine areas, so that it is unlikely that the inappropriate phenomena result from the excess and shortage of the transfer current. Therefore, a large margin can be provided for the transfer bias. This makes it possible to more freely set the switching timing and bias value for the trailing end bias control according to the present invention.

Furthermore, the polymer conductive transfer roller suffers only a small difference in resistance between the rotating direction and the longitudinal direction. Consequently, the polymer conductive transfer roller provides a stable current value with respect to an applied voltage. The resistance of the print material P can be more accurately sensed by using the polymer conductive transfer roller as the print material resistance sensing device 24 according to the third embodiment.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An image forming apparatus comprising:

an image carrier that carries a toner image;

transfer means which includes a transfer member forming a transfer nip portion together with said image carrier and which can apply a transfer bias to said transfer member to transfer the toner image carried on said image carrier to a toner image transfer area of a print material passing through said transfer nip portion;

control means for controlling a transfer bias set value set in order to apply a predetermined transfer bias to said transfer member; and size sensing means for sensing a size of the print material;

wherein if the size of the print material sensed by said size sensing means is smaller than a predetermined size, said control means switches a first transfer bias set value to a second bias set value smaller than the first transfer bias set value while the toner image transfer area of the print material is passing through said transfer nip portion, and if the size of the print material sensed by said size sensing means is larger than the predetermined size, said control means switches the first transfer bias set value to the second transfer bias set value smaller than the first transfer bias set value after the toner image transfer area of the print material has gassed through said transfer nip portion.

2. An image forming apparatus according to claim 1, wherein if the size of the print material sensed by said size sensing means is larger than the predetermined size, said control means switches the first transfer bias set value to the second transfer bias set value smaller than the first transfer bias set value after the toner image transfer area of the print material has passed through said transfer nip portion and before a trailing end of the print material passes through said transfer nip portion.

3. An image forming apparatus according to claim 2, wherein after the trailing end of the print material has passed through said transfer nip portion, said control means switches the second transfer bias set value to a third transfer bias set value larger than the second transfer bias set value.

4. An image forming apparatus according to claim 1, further comprising:

fixing means for fixing the toner image on the print material to a fixing nip portion; and conveying means disposed between said transfer nip portion and said fixing nip portion to convey the print material, wherein the predetermined size is a distance from said transfer nip portion to said fixing nip portion.

5. An image forming apparatus according to claim 1, further comprising:

print material resistance sensing means disposed upstream of said transfer member in a conveying direction, to sense a resistance value of the print material, wherein if the resistance value of the print material sensed by said print material sensing means is larger than a predetermined resistance value and if the size of the print material sensed by said size sensing means is smaller than the predetermined size, said control means switches from the first transfer bias set value to the second transfer bias set value while the toner image transfer area of the print material is passing through said transfer nip portion.

6. An image forming apparatus according to claim 5, wherein said print material resistance sensing means senses the resistance value of the print material on the basis of a current flowing through said transfer member while a predetermined transfer bias is being applied to said transfer member and while the print material is passing through said transfer nip portion.

7. An image forming apparatus according to claim 6, wherein said print material resistance sensing means senses the resistance value of the print material on the basis of a first current value of a current flowing through said transfer member while the predetermined transfer bias is being applied to said transfer member and while the print material is not passing through said transfer nip portion, and a second current value of a current flowing through said transfer member while the print material is passing through said transfer nip portion.

8. An image forming apparatus according to claim 1, wherein the second transfer bias set value is equal to or smaller than a half of the first transfer bias set value.

9. An image forming apparatus according to claim 1, wherein a time required after said material means has switched from the first transfer bias set value to the second transfer bias set value and before the transfer bias applied to said transfer member becomes the second transfer bias set value is shorter than a time required after the first transfer bias set value has been switched to the second transfer bias set value and before a trailing end of the print material reaches said transfer nip portion.

10. An image forming apparatus according to claim 1, wherein said transfer member comprises a polymer conductive material.

11. An image forming method in an image forming apparatus having an image carrier that carries a toner image, transfer means which includes a transfer member forming a transfer nip portion together with the image carrier and which can apply a transfer bias to the transfer member to transfer the toner image carried on the image carrier to a toner image transfer area of a print material passing through the transfer nip portion, and control means for controlling a transfer bias set value set in order to apply a predetermined transfer bias to the transfer member, the method comprising:

a sensing step of sensing a length of the print material, said sensing step being executed by print material sensing means disposed upstream of the transfer nip portion in a conveying direction of the print material; and a switching step of switching the first transfer bias set value to the second bias set value if the length of the print material is shorter than a distance between the transfer nip portion and a fixing nip portion of a fixing means for fixing the toner image on the print material.

12. An image forming method according to claim 11, further comprising:

a size sensing step of sensing a size of the print material, wherein if the size of the print material sensed in said size sensing step is smaller than a predetermined size, said switching step switches the first transfer bias set value to the second transfer bias set value smaller than the first transfer bias set value while the toner image transfer area of the print material is passing through the transfer nip portion, and if the size of the print material sensed by said size sensing step is larger than the predetermined size, said switching step switches the first transfer bias set value to the second transfer bias set value smaller than the first transfer bias set value after the toner image transfer area of the print material has passed through the transfer nip portion.

13. An image forming method according to claim 12, wherein if the size of the print material sensed in said size sensing step is larger than the predetermined size, said switching step switches the first transfer bias set value to the second transfer bias set value smaller than the first transfer bias set value after the toner image transfer area of the print material has passed through the transfer nip portion and before a trailing end of the print material passes through the transfer nip portion.

14. An image forming method according to claim 13, wherein after the trailing end of the print material has passed through the transfer nip portion, said switching the step switches the second transfer bias set value to a third transfer bias set value larger than the second transfer bias set value.

15. An image forming method according to claim 12, further comprising:

a resistance value sensing step of sensing a resistance value of the print material, wherein if the resistance value of the print material sensed in said resistance value sensing step is larger than a predetermined resistance value and if the size of the print material sensed in said resistance value sensing step is smaller than a predetermined size, said switching step switches from the first transfer bias set value to the second transfer bias set value while the toner image transfer area of the print material is passing through the transfer nip portion.

16. An image forming method according to claim 15, wherein said resistance value sensing step senses the resistance value of the print material on the basis of a current flowing through the transfer member while a predetermined transfer bias is being applied to the transfer member and while the print material is passing through the transfer nip portion.

17. An image forming method according to claim 16, wherein said resistance value sensing step senses the resistance value of the print material on the basis of a first current value of a current flowing through the transfer member while the predetermined transfer bias is being applied to the transfer member and while the print material is not passing through the transfer nip portion and a second current value of a current flowing through the transfer member while the print material is passing through the transfer nip portion.

18. An image forming method according to claim 11, wherein the second transfer bias set value is equal to or smaller than a half of the first transfer bias set value.

* * * * *

UNITED STATES PATENT AND TRADEMARK OFFICE

CERTIFICATE OF CORRECTION

PATENT NO. : 7,058,322 B2
APPLICATION NO. : 10/805231
DATED : June 6, 2006
INVENTOR(S) : Atsushi Iwasaki et al.

It is certified that error appears in the above-identified patent and that said Letters Patent is hereby corrected as shown below:

ON THE TITLE PAGE

At Item (56), Foreign Patent Documents, "JP 10198183A 7/1998" should read --JP 10-198183 A 7/1998--.

COLUMN 3

Line 65, "its is rigidity" should read --its rigidity--.

COLUMN 4

Line 39, "above described" should read --above-described--.

COLUMN 6

Line 58, "conveyed to" should read --conveyed--.

COLUMN 7

Line 13, "roller air 14." should read --roller pair 14.--;
Line 35, "retained an on" should read --retained and on--; and
Line 47, "from of" should read --from--.

COLUMN 8

Line 17, "ing 16a" should read --ing belt 16a--; and
Line 32, "till" should read --until--.

COLUMN 10

Line 41, "car be" should read --can be--.

COLUMN 14

Line 5, "in the" should read --in--.

COLUMN 15

Line 5, "gassed" should read --passed--.

UNITED STATES PATENT AND TRADEMARK OFFICE

CERTIFICATE OF CORRECTION

PATENT NO. : 7,058,322 B2
APPLICATION NO. : 10/805231
DATED : June 6, 2006
INVENTOR(S) : Atsushi Iwasaki et al.

It is certified that error appears in the above-identified patent and that said Letters Patent is hereby corrected as shown below:

COLUMN 16

Line 56, “the step” should read --step--.

Signed and Sealed this

Twenty-sixth Day of December, 2006

JON W. DUDAS
*Director of the United States Patent and Trademark Office*